United States Patent [19]

Austin

[11] Patent Number: 4,757,629

[45] Date of Patent: Jul. 19, 1988

[54] GUN FIRING MECHANISM

[76] Inventor: Trevor A. Austin, 37 Kowhai Street, Timaru, New Zealand

[21] Appl. No.: 805,891

[22] Filed: Dec. 6, 1985

[30] Foreign Application Priority Data

Dec. 6, 1984 [NZ] New Zealand ..... 210457

[51] Int. Cl.[4] ..... F41C 19/12

[52] U.S. Cl. ..... 42/84; 89/28.05

[58] Field of Search ..... 42/84, 99; 89/135, 1.814, 89/28.05

[56] References Cited

U.S. PATENT DOCUMENTS

| | | | |
|---|---|---|---|
| 1,945,211 | 1/1934 | Waugh et al. | 42/84 |
| 2,136,647 | 11/1938 | Stevenson | 42/84 |
| 3,086,469 | 4/1963 | Musgrave | 42/84 |
| 3,250,034 | 5/1966 | Simmons | 42/84 |
| 3,762,087 | 10/1973 | Strubin | 42/84 |
| 4,134,223 | 1/1979 | Hillenbrandt et al. | 42/84 |
| 4,246,830 | 1/1981 | Krieger | 89/179 |

*Primary Examiner*—Stephen C. Bentley
*Assistant Examiner*—Stephen M. Johnson

[57] ABSTRACT

An electrical trigger mechanism for a gun 1 has a relatively small and lightweight firing pin 5 which is held in its stationary position shown in outline 5[1] by a permanent magnet 2 or the like and in which position the firing pin is spaced apart from a solenoid coil 4.

A capacitive discharge circuit discharges through the solenoid coil upon operation of the gun trigger, the movement of or pressure on the gun trigger being detected by any suitable triggering means such as an optical interrupter, a microswitch or a strain gauge. The energizing of the solenoid coil 4 is for a sufficiently short time that the magnetic field has decayed or substantially decayed by the time the firing pin reaches the coil 4. The firing pin is therefore not restrained as it passes through the coil 4 into an abuttment member 6 which has a substantially central aperture through which the firing pin 4 can project in impacting against the bullet or cartridge 9 in position within the barrel 8. After firing, the permanent magnet 2 or the like will attract the firing pin 5 back into the stationary position ready for the next firing.

7 Claims, 4 Drawing Sheets

GUN FIRING MECHANISM

BACKGROUND OF THE INVENTION

The present invention relates to a gun firing mechanism.

Various types of gun firing mechanisms are available, principally relying on a spring biased firing pin which is urged against the primer charge of a cartridge upon the gun trigger being pressed. Such mechanisms have evolved over the past several hundred years. From the time of early percussion weapons to the present, firing mechanisms of fire arms have utilized pivoting hammers and the aforementioned spring loaded firing pins. Even free floating firing pins have been used, activated by the release of a striking member which by impact with a detonating charge is designed to prime the explosive charge to ignite it and in so doing to propel the bullet from the weapon by the force of pressure generated in the resultant explosion of the charge. Efforts have been made to improve the marksman's capabilities by providing weapons designed for greater accuracy and in particular target rifles and pistols. These have been proposed with various electronic means of hammer release which have been designed to remove the effort of activating the actual firing function means and thereby reduce movement away from the target in sighting the weapon.

Target pistols and rifles of earlier conventional designs suffered in accuracy due to the friction experienced in the cocking sear of the hammer and the effort required to release the hammer to fire the weapon. Hardened surfaces at these points in the mechanism of conventional weapons have been frequently painstakingly polished to give the smoothest possible movement on activation in firing the weapon.

The weight of the hammer and firing pin has also often been minimized to avoid as much as possible the extended effect of the actuating momentum of these when released to fire the weapon since it adds yet another movement at the crucial moment of aim and detonation.

Electronic trigger releases in some target weapons have been suggested to avoid the effort of hammer release but these have not replaced the spring tension activation of the hammer and firing pin.

Some electrical gun firing mechanisms have, however, been proposed. In U.S. Pat. No. 3,250,034 (E. P. Simmons), an electrically controlled gun firing mechanism has an electromagnet which when energized on the operation of the gun trigger attracts an armature against a spring bias. The armature has a firing pin forming an axial extension so that on such movement of the armature the firing pin will detonate a shell, the bias of the spring then returning the armature and firing pin to the inoperative position. The energizing of the electromagnet is by the discharge through the electromagnet coil of a charged capacitive circuit in conjunction with the current from a D.C. power source. In this prior art proposal, however, the armature in its inoperative position is already located Within the coil of the electromagnet. The energising of the electromagnet only moves the armature further within the coil. Also, in both the operated and unoperated positions of the armature, the firing pin or at least a portion thereof (a lesser portion after the armature has been moved) is always present within the coil of the electromagnet.

In U.S. Pat. No. 4,009,536 (Wolff) an elongate firing pin extends through the coil of an electromagnet to be connected at one end to a movable armature and to extend at its opposite end towards a cartridge against which it, or an intermediate striking lever, will impact upon movement of the armature on energization of the coil. In the embodiment for an automatic firearm Wolff proposes a supplementary electromagnet which is energized to move a supplementary armature out of a firing pin locking position concurrently with the energization of the main armature, a spring bias then returning the supplementary armature to its firing pin locking position. In both these embodiments of Wolff, however, the major portion of the firing pin is always contained within the electromagnetic coil, only a part of the firing pin moving out of the coil at one end upon attraction of the movable armature at the other end.

In U.S. Pat. No. 4,134,223 (Hillenbrandt et al) an electromagnetic coil has positioned within it a movable armature connected at one end with a firing pin. Upon energisation of the electromagnet the movement of the armature will move an end of the firing pin out of the coil to impact on a cartridge. The energisation of the coil is proposed to be by the discharge of a storage capacitor actuated by the operation of the trigger triggering a light-sensitive device.

Such prior art proposals for an electrical trigger mechanism, while having many advantages over normal spring-biased firing pin mechanisms, have still not achieved a sufficiently fast triggering time nor in automatic weapons a sufficiently fast return of the firing pin to its rest position.

It is an object of the present invention to thus provide an electrical gun firing mechanism which enables a faster triggering time to be achieved and which overcomes or at least obviates disadvantages in trigger mechanisms available to the present time.

Further objects of this invention will become apparent from the following description.

SUMMARY OF THE INVENTION

The present invention provides an electrical trigger mechanism for a gun comprising:

(i) a magnetically attractable firing pin;

(ii) biassing means to move said firing pin to, and hold it at, a first stationary position spaced apart from an electromagnet means;

(iii) said electromagnet means when energized being able to attract said firing pin from said stationary position so that said firing pin passes through said electromagnet means;

(iv) energizing means to energise said electromagnet means for a sufficiently short time that the magnetic field thereof has decayed or substantially decayed by the time said firing pin reaches said electromagnet means from said stationary position.

The present invention will now be described by way of example and with reference to possible embodiments thereof and with reference to the accompanying drawings.

DETAILED DESCRIPTION OF THE ILLUSTRATED EMBODIMENT

Figure 1:
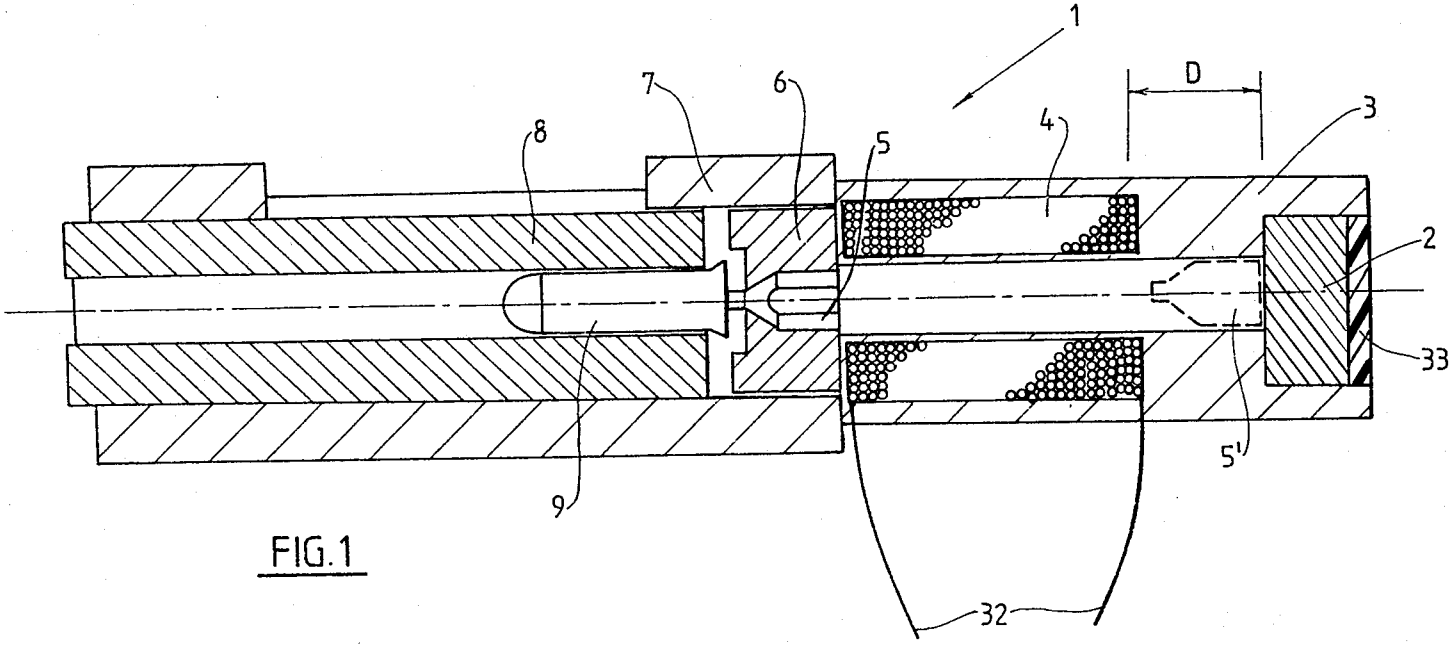
FIG. 1 shows diagrammatically a cross-sectional view of a gun firing mechanism when assembled according to one possible embodiment of the invention.

As will be clear from the description above, the present invention seeks to achieve a firing mechanism which enables a cartridge detonation with minimal movement of the weapon at the moment of detonation. Such movement can be caused firstly by the effort of hammer release and secondly by the momentum forces of the hammer and firing pin on impact with the detonating cap or case of the cartridge as the weapon is fired.

This minimal movement is achieved in the present invention by the firing pin being actuated directly by an electro-magnetic field of very short duration which provides an extremely high speed movement of the firing pin. This enables the firing pin to be considerably lighter in weight than previously used pins and it requires only a relatively short distance of travel for effective detonation of the charge to be achieved. Due to the relatively light weight of the firing pin of the present invention and its limited movement when activated, the inertia and momentum forces are such that a minimal movement of the firearm is caused by the firing pin as the weapon is fired. The present invention, therefore, can find particular application for precision target use as it enables the marksman to take precise aim and to hold that aim during the entire process of trigger activation enabling the firing pin to strike the primer charge or detonator of the cartridge at the precise moment desired when optimum aim is achieved. The trigger release may be minimal and may be adjustable as to the effort required by the marksman. Such a mechanism of the present invention by virtue of the greatly reduced forces of movement momentum and inertia of these parts enables a substantial reduction in the deflection factors of the weapon which in other weapons reduces the accuracy of the weapon.

Referring to the accompanying drawings, an embodiment of the invention is shown diagrammatically and is referenced generally by arrow 1. The firing mechanism 1 has a biassing means 2 to attract or move to, and hold the firing pin 5 at, a first stationary position, shown in outline in FIG. 1 and referenced $5^1$. The biassing means 2 may suitably be a permanent magnet of sufficient strength to attract the firing pin 5 back into the position shown in FIG. 1 after the weapon has been fired. Instead of a permanent magnet it is envisaged that an electromagnet may be utilized which is energised permanently or for example immediately after the gun has been fired. A sleeve and spacer assembly 3, suitably of a non-magnetic material such as plastics, surrounds a solenoid coil 4 through which the firing pin 5 can pass into the firing position 5. The assembly 3 also provides a spacer portion separating the end of the solenoid 4 from the magnet or other biassing and holding means 2 by a distance D which in one embodiment may be of the order of 10 mm (0.39 inches). In this way the firing pin 5 is held in its stationary position spaced apart from and outside the solenoid 4. An at least partially resilient plug 33, of plastics or the like, is shown fitted behind the magnet 2 so as to absorb the force of impact of the firing pin 5 on its return to the magnet 2. Wires 32 are shown extending from the solenoid 4 and in FIG. 2 are shown having a male plug 10 fitted at their respective ends.

Adjacent the solenoid coil 4 is the end of the stock 7 which is suitably threaded so as to accommodate an abuttment member 6 for the firing pin 5. The abuttment member 6 has a substantially central aperture through which the firing pin 5 in its firing position projects in impacting against the bullet or cartridge 9 in position within the barrel 8.

Figures 2, 3:
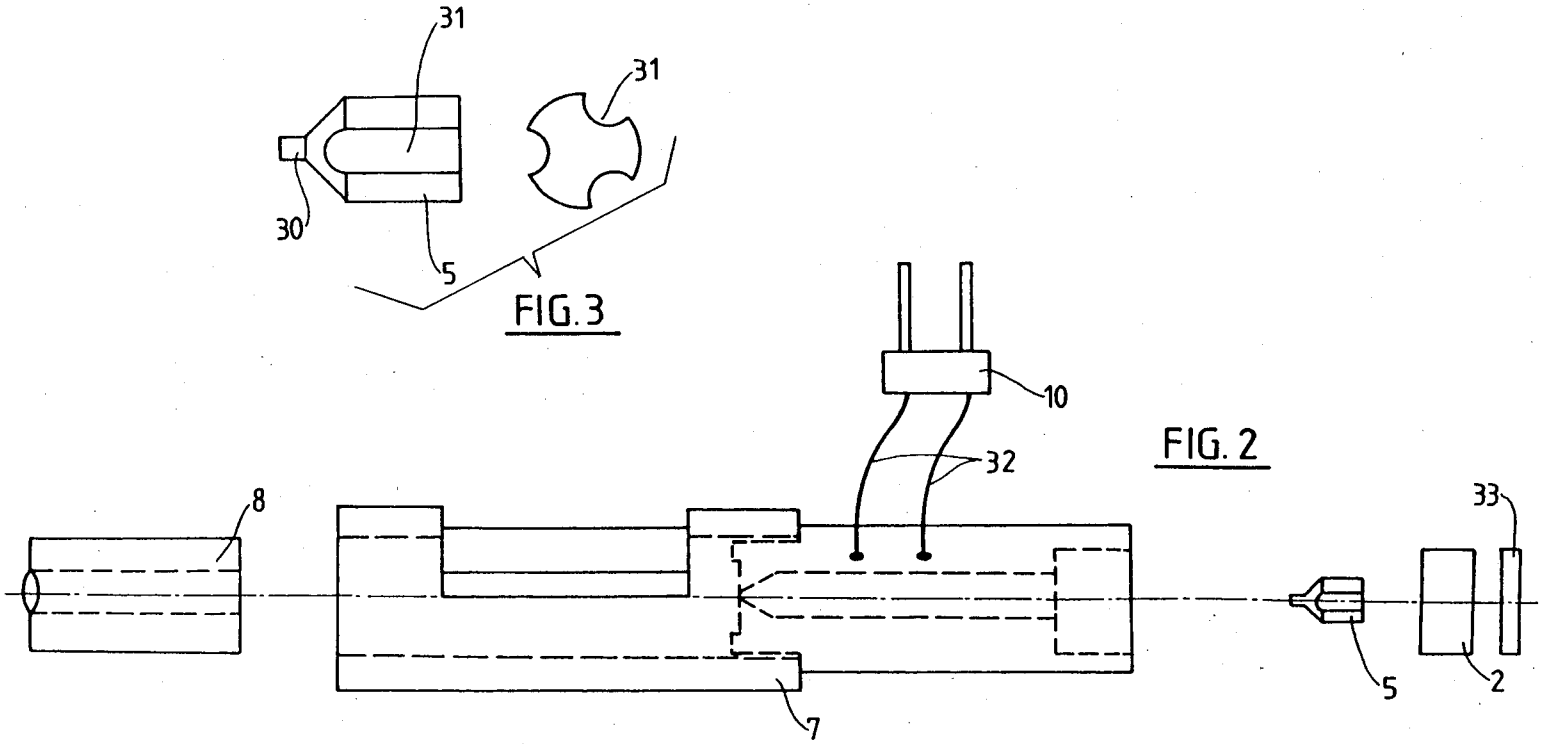
FIG. 2 shows a part-exploded view of the gun firing mechanism of FIG. 1.
FIG. 3 shows diagrammatically enlarged side and end views of the firing pin of the preceding Figures.

As is seen from FIG. 1 particularly, the firing pin 5 is relatively short compared to firing pins used in the prior art apparatus of the aforementioned U.S. Patents. This relatively small size of the firing pin 5 means that it can be of a relatively light weight. In one embodiment the firing pin may be of the order of 10 mm (0.39 inches) long and weigh about 2 grams (0.07 ounces). The lightness of the firing pin can, as shown in FIG. 3, be enhanced by a plurality of peripheral grooves 31 extending axially from the blunt end of the firing pin 5 to the projection 30 at its opposite end. The grooves 31, as well as enhancing the lightness of the firing pin 5, also assist in maximizing its speed of travel through the coil 4 in that the grooves 31 allow air to pass over the pin 5 rather than being trapped in front of it as it moves through the coil 4.

Figure 5:
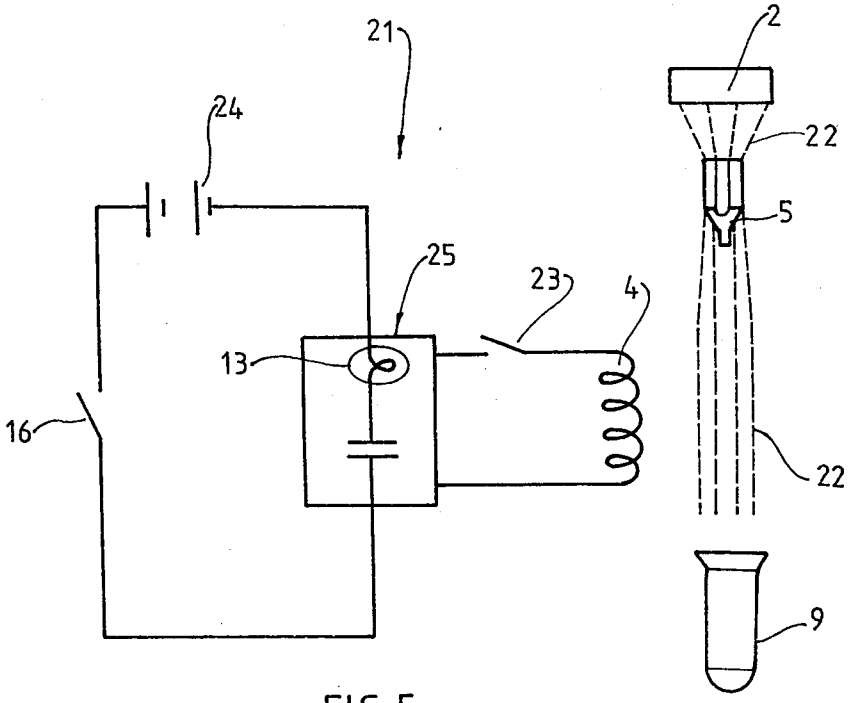
FIG. 5 shows schematically the electrical and magnetic circuit of the gun firing mechanism of the preceding Figures.

As shown schematically in FIG. 5 the magnetic field 22 created by the coil 4 when energized is effectively stretched by the presence of the magnet 2. The effect of this stretching of the magnetic field has been found to be an increased speed of the firing pin through the coil 4. It is believed that this may be due to a spring effect as the magnetic field due to the coil 4 suddenly becomes sufficient to overcome the holding effect of the magnetic field due to the magnet 2, springing the firing pin 5 from the magnet 2.

In FIG. 5 a charging circuit is referenced generally by arrow 21 and is shown schematically having a D.C. voltage source 24, an on/off switch 16, and a capacitive charging circuit 25 including a light indicator 13, which may be a light emitting diode, to which the coil 4 may be connected by switch 23.

The charging circuit 25 may be of any suitable type such as commonly used for the flash charging circuits of cameras. However, the charging circuit 25 must be such that with the switch 23 closed a pulse of the required characteristics is produced for the coil 4 which will energize it only for a sufficient period to attract the firing pin 5 and being such that the magnetic field of the coil 4 will be broken down or substantially broken down by the time the firing pin 5 enters the coil 4. This is because in the present invention the firing pin is required to pass right through the coil 4. This contrasts with the prior art proposals mentioned above where the movable armatures did not pass beyond the centrepoint of the solenoid. It is to be appreciated in this regard that if a solenoid is left energized, an armature attracted thereinto will oscilate about the mid-point of the solenoid before coming to rest at that mid-point.

The aforementioned pulse of the present invention may suitably have a voltage level of the order of 350 V for a fraction of a millisecond possibly of the order of 50 microseconds.

The switch 23 may be of any suitable type for example; a microswitch; an optical interrupter operated directly or indirectly by the trigger 20 (see FIG. 4); or a strain gauge detecting finger pressure on the trigger 20 or a component associated therewith.

Figure 4:
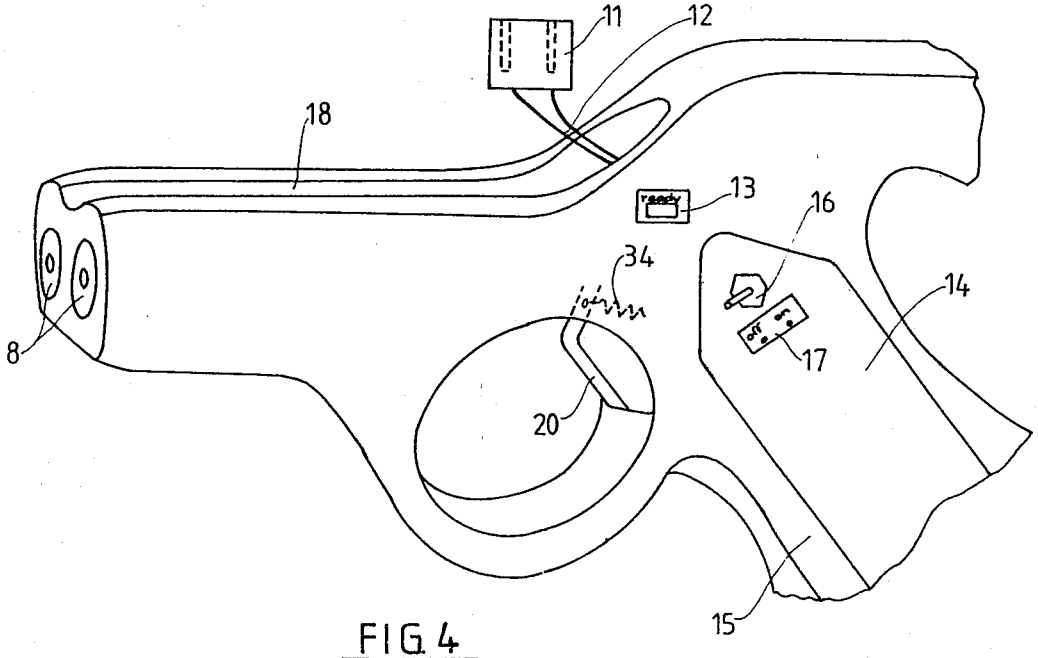
FIG. 4 shows diagrammatically a gun butt suitable to accommodate the gun firing mechanism of the preceding Figures.

As shown in FIG. 4, the gun butt 15 can have one or more triggers 20 controlling one or more barrels 8 in known manner. A recess 18 in the butt 15 is adapted to accommodate the firing mechanism 1 of the present invention. A female connector 11 will provide the electrical connection with the connector 10 of FIG. 2. A cover 14 covers over a further recess in the butt 15 in which the electrical circuit providing the power supply for the coil 4 can be positioned. The light indicator 13 of FIG. 5 is shown positioned prominently to indicate when the firing mechanism is ready for firing. The on/off switch 16 of FIG. 5 is also conveniently placed and associated with indicia 17.

It is to be appreciated that with the use of the electrical triggering system of the present invention it becomes unnecessary for heavy pressure on the trigger 20 pulling it back to initiate the triggering mechanism. However, pressure on the trigger 20 may be desirable, as a safety precaution, because of user preference, or because of regulations. The trigger 20 is thus shown in FIG. 4 associated with a biasing means, illustrated diagrammatically as a tension spring 34 whereby a desired pressure can be achieved notwithstanding that at some point in the travel of the trigger 20 a light beam may be interrupted or a microswitch operated to initiate the triggering which is entirely independent of the trigger pressure being applied. The spring or other biasing means 34 connected directly or indirectly to the trigger 20 can, therefore, provide the desired trigger pressure, for example a 3 pounds (1.36 kilogram) trigger pressure as required by some gun pistol marksmen regulations.

It has been found that with the gun firing mechanism shown in the accompanying drawings, and including the use of a permanent magnet 2 and a grooved light-weight firing pin 5 as shown in FIG. 3, a firing time of the order of 60 microseconds may be achieved. This is several hundred times faster than what has previously been achieved in the proposals of the prior art referred to above. Apart from the previously referred to benefits of the light-weight and grooved firing pin and the permanent magnet 2 of the preferred embodiment, it is believed that this speed of firing time may largely be attributable to the fact that in the present invention the firing pin is accelerated up to the coil and is then caused to travel through the coil with the coil de-energized or substantially de-energized so that the coil's previously existing magnetic field does not hinder or substantially hinder the travel of the firing pin 5 right through the coil 4.

Where in the aforegoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. An electrical trigger mechanism for a gun comprising:

(i) a magnetically attractable firing pin of low weight;

(ii) magnetic biasing means to attract said firing pin to, and hold it at, a first stationary position at one end of the path of travel of said firing pin which path of travel extends through an electromagnetic means, the bullet-impacting tip of the firing pin being spaced apart in said first stationary position from the end of said electromagnet means through which the firing pin will first pass when attracted by said electromagnet means;

(iii) said electromagnet means when energized attracting said firing pin from said stationary position so that said firing pin passes through said electromagnet means;

(iv) energizing means to energize said electromagnet means for a sufficiently short time that the magnetic field thereof has decayed by the time said firing pin reaches the axial center of said electromagnet means along said path of travel from said stationary position;

(v) said biassing means automatically attracting back the firing pin to said stationary position after it has impacted on, and rebounded from, the bullet so as to reset the mechanism.

2. An electrical trigger mechanism as claimed in claim 1 wherein said biassing means comprises a permanent magnet means.

3. An electrical trigger mechanism as claimed in claim 1 wherein said biassing means comprises a further electromagnet means.

4. An electrical trigger mechanism as claimed in claim 2 wherein a spacer assembly of a non-magnetizable material spaces apart said electromagnet means and said permanent magnet means and has an aperture therein within which said firing pin is accommodated when in said stationary position and through which aperture said firing pin passes in travelling to and through said electromagnet means, said electromagnet means having an axial aperture therethrough aligned with said aperture in said spacer assembly.

5. An electrical trigger mechanism as claimed in claim 4 wherein said firing pin includes a plurality of axially extending peripheral straight grooves along a substantial part of the axial length of the firing pin which grooves allow air to pass over the firing pin as it moves through said electromagnet means.

6. An electrical trigger mechanism as claimed in claim 5 wherein said energizing means comprises a capacitive circuit which discharges through said electromagnet means upon activation of a switch means operable by a trigger of the gun.

7. An electrical trigger mechanism as claimed in claim 6 wherein said switch means includes a strain gauge means detecting a predetermined pressure on said gun trigger.

* * * * *